US006334678B1

(12) United States Patent
Daigneault et al.

(10) Patent No.: US 6,334,678 B1
(45) Date of Patent: Jan. 1, 2002

(54) METHOD FOR APPLYING CHEMICAL WATERMARKS ON SUBSTRATE

(75) Inventors: Robert L. Daigneault, Longmeadow, MA (US); Michael F. Koenig, Goshen, NY (US); Otto Ondruska; Daniel R. Rogers, both of Erie, PA (US); Jiyue Yang, Towaco, NJ (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/388,206

(22) Filed: Sep. 1, 1999

(51) Int. Cl.[7] ..... B41J 2/01
(52) U.S. Cl. ..... 347/107; 347/100; 347/103
(58) Field of Search ..... 347/107, 100, 347/103

(56) References Cited

U.S. PATENT DOCUMENTS

| | | | | | |
|---|---|---|---|---|---|
| 3,048,100 | A | | 8/1962 | Livingstone | 101/426 |
| 3,085,898 | A | | 4/1963 | Vaurio | 117/38 |
| 3,140,959 | A | | 7/1964 | Vaurio | 117/38 |
| 3,369,252 | A | | 2/1968 | Adams | 346/75 |
| 3,373,437 | A | | 3/1968 | Sweet et al. | 346/75 |
| 3,441,427 | A | | 4/1969 | Skofronick | 117/37 |
| 3,443,979 | A | | 5/1969 | Skofronick | 117/37 |
| 3,486,923 | A | | 12/1969 | Skofronick | 117/37 |
| 3,596,275 | A | | 7/1971 | Sweet | 346/1 |
| 3,596,276 | A | | 7/1971 | Lovelady et al. | 346/1 |
| 3,985,927 | A | * | 10/1976 | Norris et al. | 428/211 |
| 4,448,445 | A | * | 5/1984 | Chang et al. | 503/206 |
| 4,504,357 | A | * | 3/1985 | Holbein et al. | 162/123 |
| 4,513,056 | A | | 4/1985 | Vernois et al. | 428/264 |
| 4,919,044 | A | | 4/1990 | Lafler | 101/141 |
| 5,055,354 | A | | 10/1991 | Simcoke | 428/342 |
| 5,118,526 | A | | 6/1992 | Allen et al. | 427/161 |
| 5,207,871 | A | | 5/1993 | Murphy et al. | 162/164.7 |
| 5,488,664 | A | | 1/1996 | Shamir | 380/54 |
| 5,510,397 | A | * | 4/1996 | Okuda et al. | 523/161 |
| 5,521,722 | A | | 5/1996 | Colvill et al. | 358/500 |
| 5,549,740 | A | * | 8/1996 | Takahashi et al. | 347/100 |
| 5,569,317 | A | * | 10/1996 | Sarada et al. | 347/100 |
| 5,659,342 | A | | 8/1997 | Lund et al. | 347/35 |
| 5,696,182 | A | * | 12/1997 | Kashiwazaki et al. | 523/161 |
| 5,829,895 | A | | 11/1998 | Hayashi et al. | 400/124.05 |
| 6,020,061 | A | * | 2/2000 | Hurley et al. | 428/336 |
| 6,113,231 | A | * | 9/2000 | Burr et al. | 347/103 |

* cited by examiner

*Primary Examiner*—John Barlow
*Assistant Examiner*—Manish S. Shah
(74) *Attorney, Agent, or Firm*—Ostrager Chong & Flaherty LLP

(57) ABSTRACT

A method and an apparatus for applying chemical watermarks to a substrate, e.g., paper, using a digital printer which prints ink in a dot matrix pattern. The ink may contain either a translucentizing agent or an opacifying agent. The printer is digitally controlled to print ink in accordance with a computer program corresponding to a desired pattern or image.

30 Claims, 3 Drawing Sheets

METHOD FOR APPLYING CHEMICAL WATERMARKS ON SUBSTRATE

FIELD OF THE INVENTION

This invention generally relates to the manufacture of substrates having translucent or shadowed watermarks printed thereon. In particular, the invention relates to the manufacture of paper having chemical watermarks printed thereon.

BACKGROUND OF THE INVENTION

Particularly in office operations of commercial enterprises, it is often desirable to have writing stationary and other forms of business and professional papers watermarked. Watermarks are defined as translucent or opacified areas in a sheet of paper that are formed into identifiable designs such as company names, logos and seals, and are used in paper for security and prestige.

In accordance with one conventional type of shadow marked paper, shadow watermarks are formed by decreasing the density of the paper fibers in a portion of a sheet of paper relative to the density of remaining portions of the paper. Such shadow watermarks are conventionally formed in the papermaking process by contacting a wet web of paper on a Four-drinier paper machine with a dandy roll (i.e., a metal mesh roll) having an indented or recessed surface conforming to the watermark design image to be formed on the paper. During such contact the paper fibers accumulate in the indented or recessed surface, resulting in decreased density of the paper fibers in that localized area. Such shadow watermarks tend to be relatively more opaque than the remainder of the paper, i.e., they tend to transmit less light relative to the remainder of the paper.

Similarly, translucent watermarks can be formed using the reverse procedure in which a dandy roll with a raised design contacts the wet paper to compress the paper fibers and increase their density in that localized area. The compressed area on the substrate becomes relatively more translucent (due to reduced entrapped air and light refraction) and makes the watermark design visible when light is passed through the substrate.

In accordance with a more recent method for manufacturing watermarked paper by impregnating the paper with a solution containing a chemical agent that changes the light-transmitting properties of the impregnated areas. In the case of translucent watermarks, the areas to be watermarked are impregnated with a chemical composition having the ability to render opaque or semi-opaque paper more translucent or substantially transparent, i.e., a solution containing translucentizing agent. In addition, the chemical composition should not alter the surface of the paper adversely. For example, it must not render the surface glossy in the impregnated area and must not alter the erasability characteristic of the paper. Also, the chemical composition must withstand aging without discoloration and must not become indistinct through migration of the chemicals or otherwise. Finally, aside from low cost, the chemically watermarked area must accept typing, penciling, printing and writing inks without adverse effects such as feathering or skipping.

In the case of chemical shadow watermarks, the paper is impregnated with an opacifying agent instead of a translucentizing agent. The chemical shadow watermarks must satisfy the conditions set forth in the previous paragraph.

The conventional chemical watermarking process uses the flexo printing process to induce a translucentizing (or opacifying) chemical polymer into the substrate. The flexo printing plate contains the watermark design and imparts the design to the printed area to form the watermark.

The cost to produce watermarked papers on a paper machine is high, particularly in small (e.g., 500 lb.) quantities. The current method of producing chemical watermarks reduces the cost of manufacture, but still is not profitable in small quantities. Thus there is a need for a method of applying chemical watermarks which will further reduce the cost of manufacturing in small quantities.

SUMMARY OF THE INVENTION

The present invention is a method and an apparatus for applying chemical watermarks to a substrate, e.g., paper, using a digital printer which applies ink in a dot matrix pattern. In accordance with the preferred embodiment of the invention, the digital printer is an ink jet printer. Any type of ink jet printer can be used, including ink jet printers of the thermal (bursting vapor bubbles), piezoelectric and continuous (ultrasound) varieties.

The invention allows watermarks to be printed digitally and on demand. The application of chemical watermarks using a digital printer allows a great degree of customization and the production of low volumes at an affordable cost to the user. In addition, the digital aspect allows production of watermarked papers in a shorter period of time as compare to conventional manufacturing practices involving the application of chemicals.

DETAILED DESCRIPTION OF THE PREFERRED EMBODIMENTS

The present invention is a method for applying chemical translucentizing or opacifying agents on a substrate using a digital (i.e., dot matrix-producing) printer. The substrate preferably comprises a web of entangled fibers. The fibers may be cellulose fibers, natural fibers or polymeric fibers. Alternatively, the substrate may consist of a continuous film of polymeric material.

In accordance with one preferred embodiment, a translucentizing ink is applied comprising any chemicals having an index of refraction in the range of 1.0 to 1.6. For example, the translucentizing ink formulation may comprise paper sizing agent, organic oils, natural oils, weight alcohols, radiation-curable acrylates and alkyds. The translucentizing agent can be water based, solvent based or 100% solids. In the case of solvent-based agents, organic solvents such as alcohol, acetone or acetate can be used.

Figure 1:
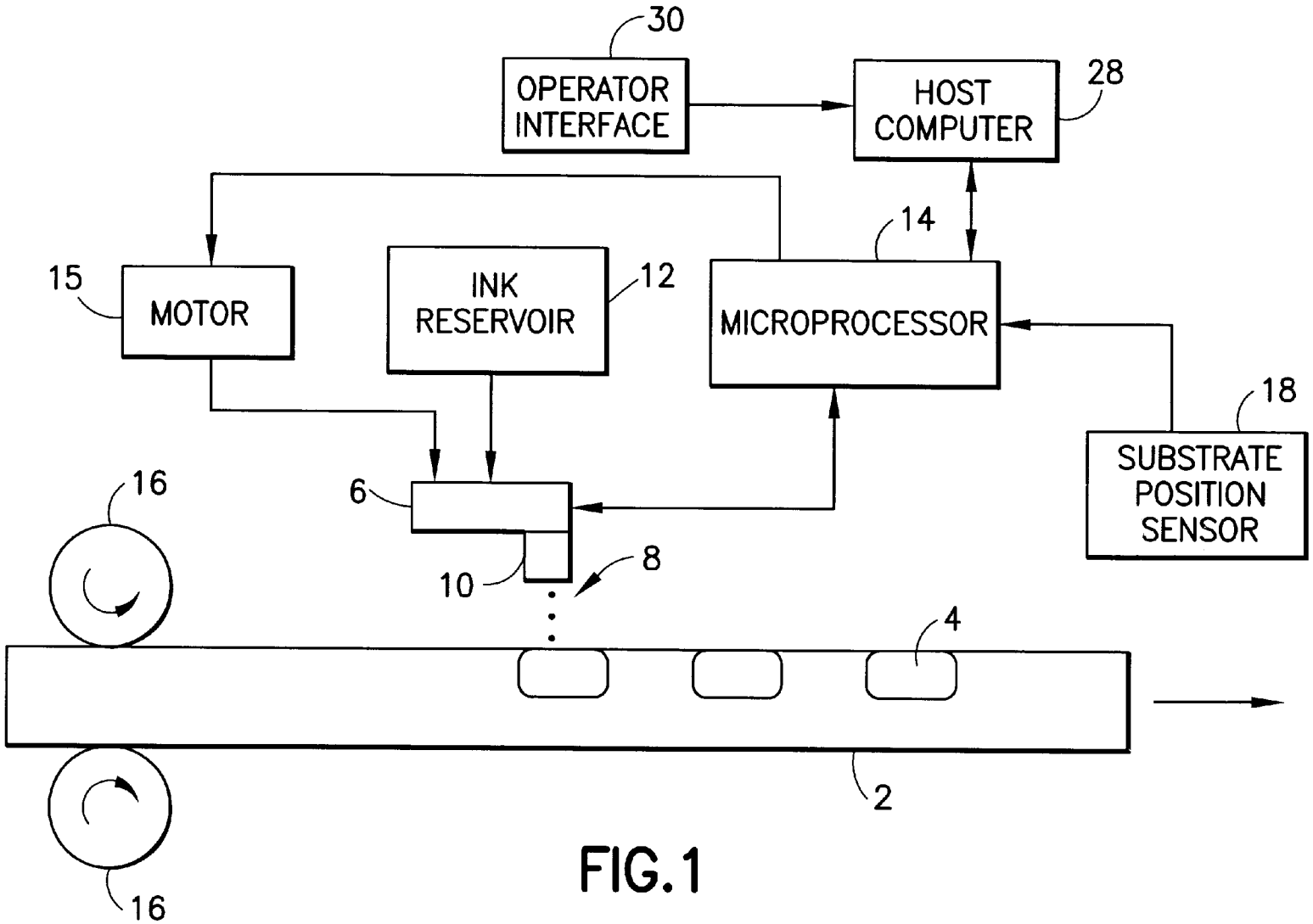
FIG. 1 is a schematic showing application of chemical watermarks or shadow marks on a substrate using an ink jet printer.

A preferred embodiment of the invention is generally depicted in FIG. 1. A substrate 2 is shown in FIG. 1 being translated from left to right during passage through a conventional ink jet printer. The exemplary ink jet printer shown in FIG. 1 comprises a printhead 12 and a sheet or web feeding mechanism 16, both of which are controlled by a printer controller in the form of a microprocessor 14. The ink jet printer is in turn controlled by a host computer 28 operated by a user via an operator interface 30 (e.g., a key-board). The host computer 28 is connected to the ink jet printer by an electrical cable and appropriate interfaces.

Still referring to FIG. 1, chemical watermarks 4 are formed in the substrate 2 by impregnating a surface of the substrate with ink comprising a translucentizing or an opacifying agent. Although FIG. 1 shows the application of chemical watermarks 4 on only one side of the substrate 2, chemical watermarks can be applied to both sides of the substrate, e.g., by passing the substrate through the ink jet printer two times in a well-known manner.

In accordance with the preferred embodiment, the chemical watermarks 4 are applied on the substrate 2 by a printhead 6 which bombards the substrate surface with droplets 8 of ink from reservoir 12 via a multiplicity of nozzles or jets 10. Only one nozzle is depicted in FIG. 1. Preferably, the ink reservoir 12 is a conventional ink jet cartridge. The person skilled in the art will readily appreciate that the printhead may be stationary or of the scanning variety. In the case of a stationary printhead, an array of nozzles 10 extends across the full width of the paper and ink is applied as the substrate is continuously translated by a sheet or web feeding mechanism, such as feed rollers 16. Motors for driving rotation of feed rollers 16, preferably under the control of microprocessor 14, are not shown in FIG. 1. In the case of a scanning printhead, the substrate is moved in increments by the sheet or web feeding mechanism. After each incremental translation, the substrate is stationary while the printhead is translated across the width of the substrate.

Whether the substrate or the printhead is moved during printing, the nozzles are electrically activated and individually controlled by the microprocessor 14. The microprocessor in turn receives instructions from the host computer 28. The host computer 28 comprises a CPU and memory for storing computer code corresponding to the desired watermarked pattern or image. A multiplicity of patterns and/or images may be pre-stored in the memory of the host computer 28. The system operator may select a desired pattern or image by inputting appropriate commands via the operator interface 30. The microprocessor 14 then controls the printhead 6 in accordance with printing instructions transmitted by the host computer 28.

In the case of a stationary printhead, the microprocessor 14 controls activation of the nozzles 10 as a function of the position of the moving substrate 2. In one preferred embodiment, a substrate position sensor 18 can be arranged to detect the leading edge of the moving substrate and provide a feedback signal to the microprocessor in response to that detection. The substrate position sensor 18 may, e.g., take the form of a microswitch or an optical sensor comprising a light-emitting diode and a photodetector. The feedback signal from the substrate position sensor establishes a reference position which enables the microprocessor 14 to determine subsequent positions of the moving substrate. For example, angular rotation detectors can be arranged to detect rotation of the feed rollers 16 and provide further feedback to the microprocessor concerning the changing position of the moving substrate 2. It will be readily appreciated by persons skilled in the art, however, that various techniques can be used to detect the changing position of the substrate. The microprocessor is programmed to control the nozzles of a stationary printhead as a function of the substrate position.

In the case of a scanning printhead, in addition to controlling activation of the nozzles, the microprocessor 14 controls the scanning position of the printhead. For example, the printhead 6 may be rotatably mounted on a guide bar (not shown) and connected to an endless belt (not shown) driven to rotate by a motor 15. Thus, via operation of the motor 15 and circulation of the endless belt, the printhead 6 can be moved in a reciprocating manner between the motor and an idler puller (not shown). When the substrate position sensor 18 detects the presence of the substrate 2, the microprocessor 14 controls the operation of the motor 15 to move the printhead 6 across the surface of the substrate 2 to apply chemical watermarks thereon.

The application of chemical watermarks in accordance with the preferred embodiment of the invention is carried out by synchronizing the ink jet printhead with the substrate feed mechanism, which can be carried out in any one of many conventional ways. For example, the microprocessor 14 can be programmed to actuate the printhead 6 in synchronism with receipt of a feedback signal indicating that the substrate 2 is in a predetermined position relative to the printhead. The microprocessor 14 then controls the printhead to apply translucentizing or opacifying ink at the desired locations on the substrate.

In the cases of curable polymers, a curing station 32 (see FIG. 1) will be located downstream of the ink jet printer. In the case of heat-curable polymers, curing station 32 will be a heater; in the case of radiation-curable polymers, curing station 32 will be a source of radiation.

Fundamentally, all kinds of ink jet printers may be used to apply chemical watermarks to substrates in accordance with the present invention, including thermal ink jet printers, piezoelectric ink jet printers and continuous ink jet printers. The structure and operation of such ink jet printers is generally known. However, by way of example, the structure and operation of a typical piezoelectric ink jet printer will be described.

Figure 2:
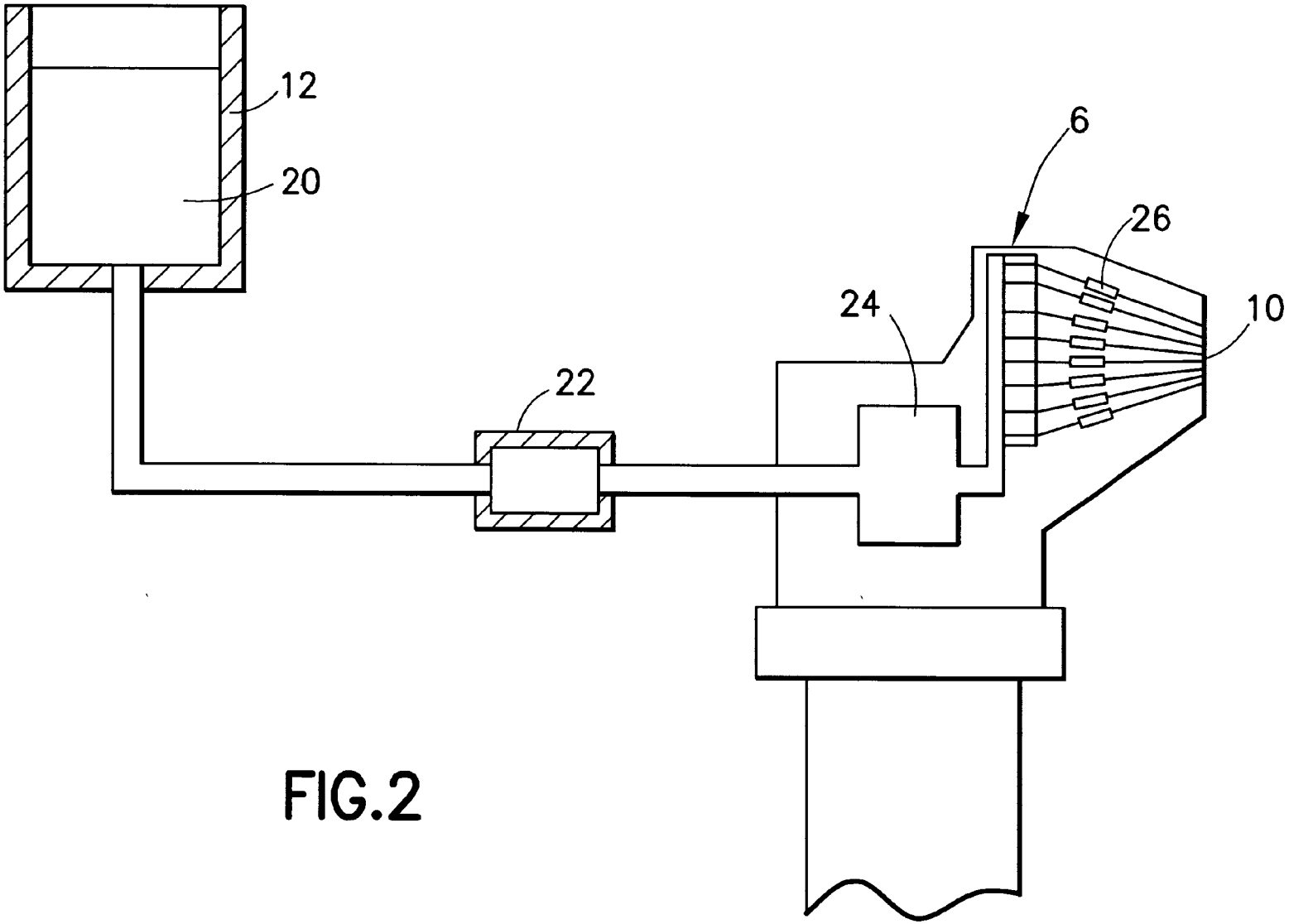
FIG. 2 is a schematic showing a conventional ink jet printer which can be used in the manufacturing process according to a preferred embodiment of the invention

One typical piezoelectric ink jet printer functions in accordance with the percussion wave principle, which is schematically illustrated in FIG. 2. The ink 20 is passed by means of capillary forces from the tank 12 through an ink filter 22 and then to the jets or nozzles 10. A vacuum control system 24 prevents the ink from flowing out of the nozzles. The nozzles are each surrounded by piezoelectric ceramic elements 16 which can be excited to contract by means of electrical signals. Contraction of a piezoelectric ceramic element 16 produces the pressure required for ejecting droplets of ink from a respective nozzle 10.

Figure 3:
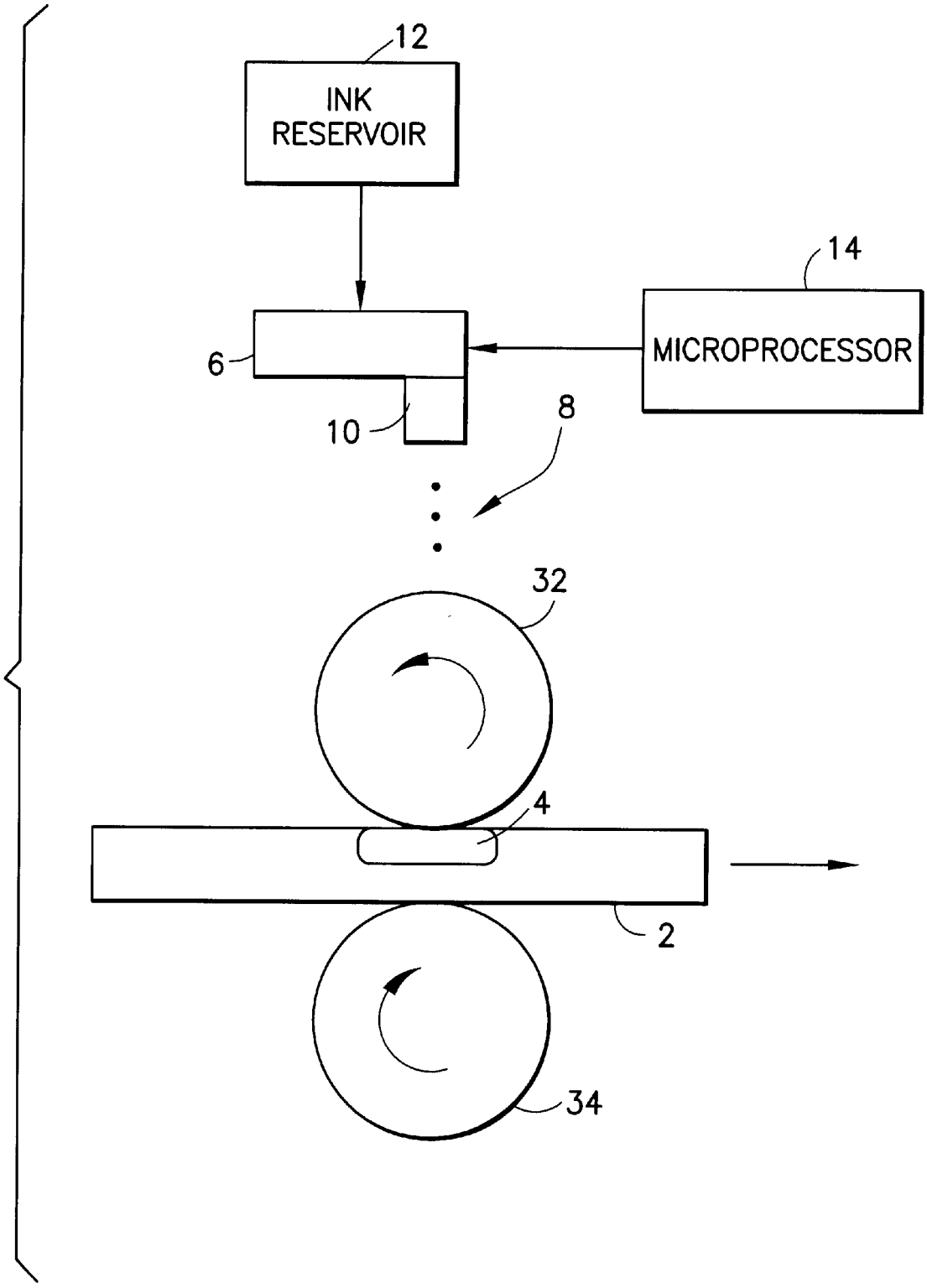
FIG. 3 is a schematic showing a conventional ink jet printer being used in conjunction with a transfer printing mechanism in accordance with a further preferred embodiment of the invention.

In accordance with further preferred embodiments of the invention, the ink jet printer ink is applied to the substrate via a transfer printing mechanism. The ink is jetted out from an ink jet printhead onto a transfer surface, which is then brought into contact with the substrate to impart the image onto the substrate surface. An example of such an arrangement is shown in FIG. 3. The nozzles 10 of the printhead 6 are controlled by the microprocessor 14 to apply ink from reservoir 12 onto the circumferential surface of a transfer roll 32. The substrate 2 is fed through a nip formed by the transfer roll 32 and an opposing press roll 34, which rotate in opposite directions. When a portion of the surface of transfer roll 32 carrying ink engages the substrate 2, the ink penetrates the substrate surface to form a chemical watermark 4.

EXAMPLE 1

One ink comprising a translucentizing chemical agent suitable for use in ink jet printers has the following formulation:

| | |
|---|---|
| Polyethylene glycol | 79 parts |
| Water | 20 parts |
| 1-Methoxy propanol | 1 part |
| Triton X-100 | Add until a surface tension of 27–30 dynes is reached |

Triton X-100 is a nonionic surfactant. This formulation was inserted into a ink cartridge of an ink jet printer and then printed on a sheet of paper. Next, the sheet of paper was heated to 60° C. to melt the polyethylene glycol. The melted polyethylene glycol then soaked into, i.e., impregnated, the paper, thereby creating the watermark. It will be readily appreciated by persons skilled in the formulation of ink jet printer inks that flow modifiers, antioxidants and bactericides can be added to the above formulation as necessary to round out the ink performance.

EXAMPLE 2

Another translucentizing ink, which does not require heating to melt the components, has the following formulation:

| | |
|---|---|
| Disaccharide | 30 parts |
| Water | 30 parts |
| Triton X-100 | 5 parts |
| 1-Methoxy propanol | 1 part |

The watermark is formed as the ink is applied, without heating. Carbohydrates different than disaccharide can also be used as the translucentizing agent.

In accordance with further variations, watermarks can be printed on paper using ink formulations in which the translucentizing agent is polyethylene oxide, cellulose or modified cellulose. Alternative polymers suitable for use in the invention include acrylate-based polymers, cross-linkable polymers (e.g., epoxy and melamine-formaldehyde), radiation-curable polymers, and heat-curable polymers.

EXAMPLE 3

A sizing agent suitable for use in the invention has the following formulation:

| | |
|---|---|
| Alkyl succinic anhydrate | 40% |
| Isopropynol | 60% |

Alkyds different than alkyl succinic anhydrate can also be used.

EXAMPLE 4

An ink jet printer ink comprising a translucentizing oil has the following formulation:

| | |
|---|---|
| Linseed oil | 40% |
| Acetate | 30% |
| Isopropynol | 30% |

EXAMPLE 5

A suitable ink jet printer ink comprising a radiation-curable polymer has the following formulation:

| | |
|---|---|
| Acetate | 30% |
| Ethanol | 27% |
| Polyethylene glycol diacrylate | 20% |
| Trimethylolopropane triacrylate | 20% |
| α-Dimethylaminodeoxybenzoin | 3% |

EXAMPLE 6

A suitable 100% solids ink has the following formulation:

| | |
|---|---|
| Polyethylene glycol diacrylate | 50% |
| Trimethylolopropane triacrylate | 47% |
| α-Dimethylaminodeoxybenzoin | 3% |

EXAMPLE 7

Another suitable ink jet printer ink has the following formulation:

| | |
|---|---|
| Diepoxide | 40 parts |
| Polyalcoholes | 10 parts |
| Isopropanol | 48 parts |
| Antimony salts | 2 parts |

In accordance with other preferred embodiments of the invention, an opacifying agent, e.g., titanium oxide, can be added to each of the foregoing ink formulations for use in printing shadow marks.

Optionally, a fluorescent agent can be added to the ink formulation to enable the watermarked paper to be authenticated by placement of the paper underneath an ultraviolet lamp. Suitable fluorescent agents include, but are not limited to, the following: benzophenone, 2,4-dihydroxybenzophenone, 2-hydroxy-4-methoxybenzophenone, and 2-(2'-hydroxy-5'-methylphenyl)benzotriazole.

In accordance with another preferred embodiment, the ink formulation may comprise a phase change ink, e.g., a thermal wax ink, which undergoes a phase change following application. For example, in the case of a thermal wax ink, molten ink is jetted out from a heated printing head onto a substrate. Some of the molten ink permeates below the surface of the substrate. Upon cooling, the molten ink solidifies on and below the surface of the substrate.

In accordance with a further alternative, a colorant may be added to the above ink formulations to produce a color watermark.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

As used in the claims, the term "translucentizing agent" means a chemical agent having the property of increasing the translucence of areas of a substrate impregnated with that agent. Similarly, the term "opacifying agent" means a chemical agent having the property of increasing the opacity (i.e., decreasing the translucence) of a substrate impregnated with that agent.

What is claimed is:

1. A method for applying a chemical watermark on a substrate, comprising the steps of:

supplying a digital printer with an ink comprising a translucentizing agent;

inserting a substrate in the digital printer; and operating the digital printer to apply said ink to said substrate.

2. The method as recited in claim 1, wherein the digital printer is an ink jet printer.

3. The method as recited in claim 1, wherein the digital printer has a stationary printhead.

4. The method as recited in claim 1, wherein the digital printer has a scanning printhead.

5. The method as recited in claim 2, wherein the ink jet printer is of the thermal variety.

6. The method as recited in claim 2, wherein the ink jet printer is of the piezoelectric variety.

7. The method as recited in claim 2, wherein the ink jet printer is of the continuous variety.

8. The method as recited in claim 1, wherein said translucentizing agent has an index of refraction in the range from 1.0 to 1.6.

9. The method as recited in claim 1, wherein said translucentizing agent is a carbohydrate.

10. The method as recited in claim 1, wherein said translucentizing agent is a sizing agent.

11. The method as recited in claim 1, wherein said translucentizing agent is taken from the group consisting of natural oils and organic oils.

12. The method as recited in claim 1, wherein said translucentizing agent is a radiation-curable polymer.

13. The method as recited in claim 1, wherein said translucentizing agent is an alcohol.

14. The method as recited in claim 1, wherein said translucentizing agent is an alkyd.

15. The method as recited in claim 1, wherein said translucentizing agent is a cross-linkable polymer.

16. The method as recited in claim 1, wherein said ink further comprises a fluorescent agent.

17. The method as recited in claim 1, wherein said ink further comprises an organic solvent.

18. The method as recited in claim 1, wherein said ink is a phase change ink in a molten state.

19. The method as recited in claim 1, wherein said substrate comprises cellulose fibers.

20. The method as recited in claim 1, wherein said substrate comprises synthetic fibers.

21. The method as recited in claim 1, wherein said substrate comprises natural fibers.

22. A method for applying a chemical watermark on a substrate, comprising the steps of:

supplying a digital printer with an ink comprising an opacifying agent;

inserting a substrate in the digital printer; and operating the digital printer to apply said ink to said substrate.

23. The method as recited in claim 22, wherein the digital printer is an ink jet printer.

24. The method as recited in claim 22, wherein said opacifying agent is titanium oxide.

25. A method for applying a chemical watermark on a substrate, comprising the step of digitally applying an ink comprising a chemical agent on a substrate at locations corresponding to a desired watermark, said chemical agent having the property of changing the translucence of said substrate at said locations.

26. The method as recited in claim 25, wherein said step of digitally applying an ink is carried out using an ink jet printer.

27. The method as recited in claim 25, wherein said chemical agent is a translucentizing agent.

28. The method as recited in claim 27, wherein said translucentizing agent has an index of refraction in the range from 1.0 to 1.6.

29. The method as recited in claim 25, wherein said chemical agent is an opacifying agent.

30. A method for applying a chemical watermark on a substrate, comprising the steps of:

supplying a digital printer with an ink comprising a translucentizing or opacifying agent;

operating the digital printer to apply said ink to a transfer surface; and bringing a substrate into contact with said transfer surface.

* * * * *